US006602134B2

(12) United States Patent
Wood et al.

(10) Patent No.: US 6,602,134 B2
(45) Date of Patent: Aug. 5, 2003

(54) DRAW POKER GAME IN WHICH PLAYER MAKES ADDITIONAL WAGERS FOR REPLACEMENT CARDS

(76) Inventors: Michael W. Wood, 11831 Wentling Ave., Suite #C, Baton Rouge, LA (US) 70816; Terry L. Wilson, 11831 Wentling Ave., Suite #C, Baton Rouge, LA (US) 70816

( * ) Notice: Subject to any disclaimer, the term of this patent is extended or adjusted under 35 U.S.C. 154(b) by 0 days.

(21) Appl. No.: 09/909,525

(22) Filed: Jul. 20, 2001

(65) Prior Publication Data

US 2002/0037762 A1 Mar. 28, 2002

Related U.S. Application Data

(60) Provisional application No. 60/223,580, filed on Aug. 7, 2000.

(51) Int. Cl.[7] ..... A63F 9/24

(52) U.S. Cl. ..... 463/13; 273/139

(58) Field of Search ..... 463/12–14, 16, 463/18–19, 22, 25–27, 30–31, 37, 43; 273/139, 269, 274, 273, 292, 303, 306

(56) References Cited

U.S. PATENT DOCUMENTS

| | | | | | |
|---|---|---|---|---|---|
| 5,407,209 | A | * | 4/1995 | Prerost | 273/292 |
| 5,851,148 | A | * | 12/1998 | Brune et al. | 463/25 |
| 5,882,259 | A | * | 3/1999 | Holmes, Jr. et al. | 463/13 |
| 6,132,311 | A | * | 10/2000 | Williams | 463/13 |
| 6,416,407 | B1 | * | 7/2002 | Carrico et al. | 463/13 |
| 6,454,649 | B1 | * | 9/2002 | Mattice et al. | 463/17 |

* cited by examiner

*Primary Examiner*—Joe H. Cheng
*Assistant Examiner*—K. Nguyen
(74) *Attorney, Agent, or Firm*—John Edward Roethel

(57) ABSTRACT

A card game in which the player makes a wager, preferably a five credit wager, and the player is then dealt an initial five card hand. The player may then stand on his initial five cards or the player may discard unwanted cards and receive a replacement cards for each card that is discarded. In order to discard unwanted cards, the player must make an additional wager, preferably in the amount of one additional credit, for each card that the player wishes to discard. The final five card is analyzed for poker hand ranking and if the player has achieved a winning poker hand, the player is paid in accordance with a pay table based on the total number of credits wagered by the player.

16 Claims, 5 Drawing Sheets

DRAW POKER GAME IN WHICH PLAYER MAKES ADDITIONAL WAGERS FOR REPLACEMENT CARDS

CROSS-REFERENCE TO RELATED APPLICATION

This application is related to and claims the benefit of U.S. Provisional Application Serial No. 60/223,580, filed Aug. 7, 2000, entitled "Poker Game".

BACKGROUND OF THE INVENTION

This application relates to a poker game and more particularly to a poker game suitable for play in an electronic video poker game format in which the player makes an additional wager for each card that the player draws.

Electronic video poker games have been prevalent in gaming casinos for many years. The basic game of video poker involves a game of five card draw poker. An electronic video gaming machine is programmed to electronically shuffle a single deck of playing cards. After the shuffle is completed and the player has made a wager to participate in the play of the game, the player is dealt an initial five card hand which is displayed on the video screen display of the gaming machine.

The player then selects which of the initial five cards the player wishes to hold, if any, and the unheld cards are then discarded. Using the same starting deck of playing cards, replacement cards are dealt for the cards that were discarded. These five cards comprise the player's final five card hand and this final hand is analyzed based on poker hand ranking. If the player has a winning poker hand combination, which generally requires that the player has achieved at least a pair of Jacks or better, the player wins with the amount of the player's winnings determined based on the type of poker hand achieved and the amount of the player's wager.

Video poker is generally played on an electronic video gaming machine that uses a video screen display to show the cards to the player. Computer controls carried on a printed circuit board mounted on the interior of the gaming machine electronically shuffle the deck of cards, activate the dealing sequence in response to input by a player, cause the initial five cards to be displayed on the video screen display, deal replacement cards after the player has selected which cards to hold and discard and analyze the final five card hand to determine winning and losing hands. The computer controls also effect payouts to the player based on the amount of the player's wager and the poker hand ranking of the final five card hand.

The electronic video poker gaming machine is designed to replicate the play of a hand of poker. Typically, the player is not playing against any other players or against a dealer's hand; the player is simply attempting to achieve the highest ranking poker hand possible from the cards displayed to the player. The higher the poker hand achieved by the player, the greater the player's winnings based on the number of coins, tokens or credits wagered by the player. Typically, a payout schedule is posted on the gaming machine to advise the player of the payoffs available for certain winning card combinations.

The original classic draw poker machines were then modified to use jokers as wild cards or to use deuces (or even other cards) as wild cards. "Joker's Wild" and "Deuces Wild" draw poker still display to the player a single five card hand and allow the player to discard unwanted cards and receive replacement cards. The payout table is modified to recognize the differing odds for achieving various poker hands when wild cards are involved.

As the video poker gaming market has evolved over the years, gaming casino operators are desirous of having different types of electronic video poker games to offer to the players. There is a need to provide new and interesting electronic video poker games that attract players and that can increase the volume of wagering in each gaming machine.

Also, as players become more sophisticated regarding electronic video poker gaming machines, players prefer to play those poker machines that have pay tables with higher payouts for the types of poker hand rankings that are achievable. There is a need for new video poker gaming machines that are capable of encouraging a high volume of play while at the same time offering what the players consider to be good pay tables.

SUMMARY OF THE INVENTION

The method of the present invention involves a card game in which the player makes a wager, preferably a five credit wager, to start the game and the player is then dealt an initial five card hand. The player may then stand on his initial five cards or the player may discard unwanted cards and receive a replacement cards for each card that is discarded. In order to discard unwanted cards, the player must make an additional wager, preferably in the amount of one additional credit, for each card that the player wishes to discard.

The final five card is analyzed for poker hand ranking and if the player has achieved a winning poker hand, the player is paid in accordance with a pay table based on the total number of credits wagered by the player.

DETAILED DESCRIPTION OF THE PREFERRED EMBODIMENTS

The electronic video poker game of the present invention is designed to be played by having the playing cards displayed on a video screen to a player. To initiate the game, the player makes a wager, preferably five credits or five coins or five gaming tokens, to be eligible to participate in the play of the game. (Throughout this description, the term "credit" will be used to refer to a monetary value and "credit" is intended to include not only credits accrued on the gaming machine, but also coins or gaming tokens that may be inserted into the gaming machine and are the monetary equivalent of credits).

A deck of cards is electronically shuffled and an initial five card hand is selected randomly and displayed to the player, all cards of the starting hand being displayed face up. The player looks at the starting hand of five cards and decides which, if any, of the initial five cards the player wishes to discard. For each card that the player wishes to discard, the player must make an additional wager, preferably one credit.

By manipulating buttons on the button panel of the gaming device or by using conventional touch screen technology, the player plays the initial five card hand. The player selects which cards he wishes to hold and, thus, which cards he wishes to discard. The player activates a draw button and replacement cards are then displayed for the discarded cards forming the first five card hand. This final five card hand is analyzed for poker hand ranking and the outcome of the play of the hand is determined. An award is paid to the player for winning hand combinations based on the poker hand ranking achieved and the total amount of the player's wager.

Figure 1:
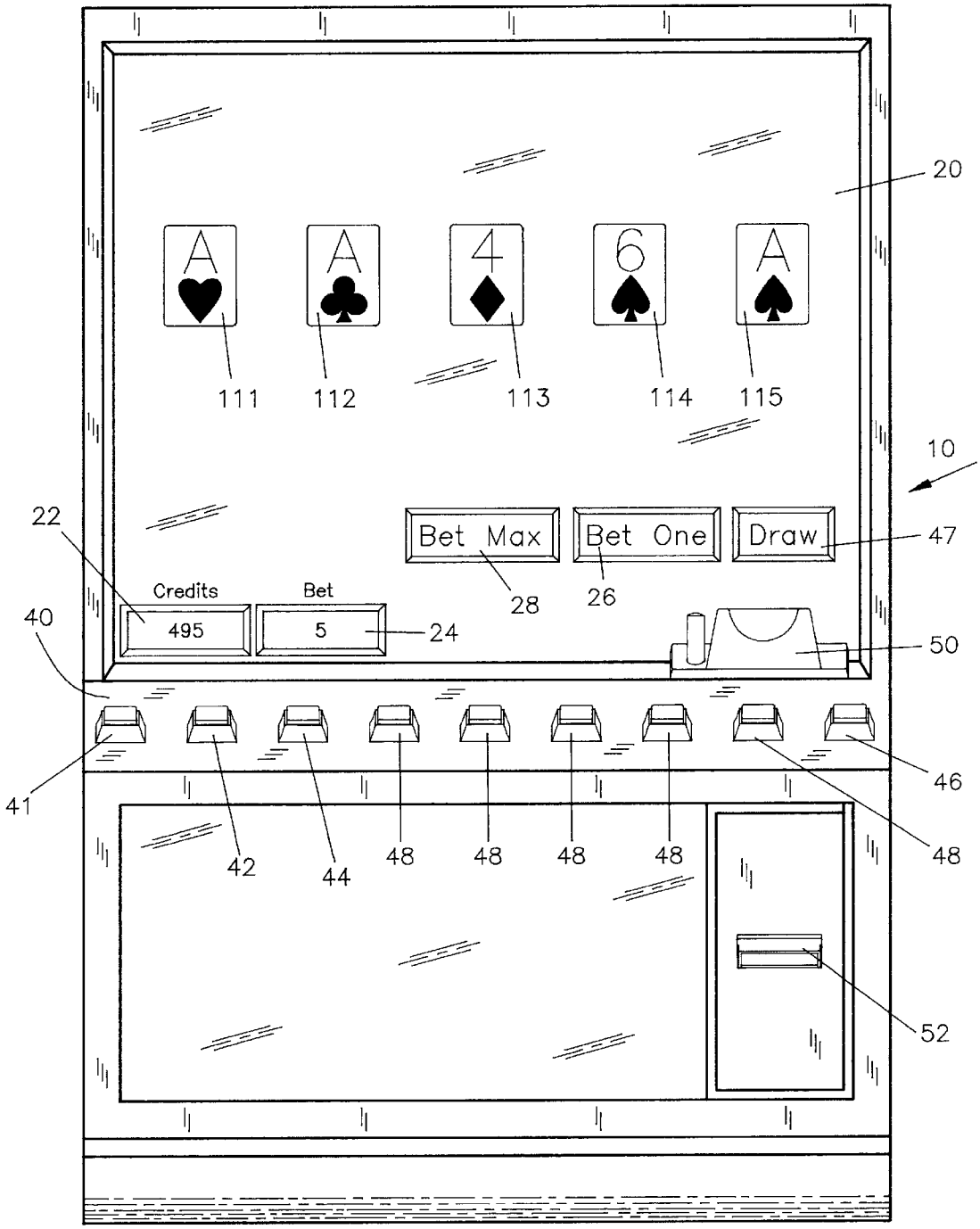
FIG. 1 shows a gaming machine that can be used to practice the method of the present invention showing the initial deal of cards for Example 1.

FIG. 1 shows a gaming machine upon which the method of the present invention can be carried out. The gaming machine includes a video screen display 20 on which is shown the playing cards that will be used during the play of the method of the present invention. The video screen display 20 also includes other information and data presented to the player to allow the player to understand the play of the game and to effect the operation of the method.

In the preferred embodiment of the present invention, the video screen display shows a credit meter 22 and a display of the total number of credits 24 wagered for a particular round of play of the game. The video screen display also has touch screen locations to allow the player to DRAW 47 replacement cards and to make his initial wager, which can be made one credit at a time using the BET ONE location 26 or which can be made by wagering the maximum number of credits allowed by the gaming machine using the BET MAX location 28.

Each of the card locations on the video screen display can also be touch screen locations so that the player may designate which cards he wishes to hold by merely touching the card location on the video screen display 20.

The gaming machine 10 also has a button panel 40 which includes typical buttons that the player may press to activate various actions during the play of the method of the present invention. A CASH OUT button 41 is provided to allow the player to collect any credits which the player has accrued on the credit meter 22. A BET MAX button 42 and a BET ONE button 44 are provided to allows the player to wager either the maximum amount of credits or to wager one credit at a time on the play of the game as desired by the player. A DRAW button 46 is provided to allow the player to effect the draw step of the method of play as desired should the player prefer to use the button panel instead of the DRAW touch screen location 47 on the video screen display 20. A plurality of HOLD buttons 48 are also provided to allow the player to select which cards the player wishes to hold should the player prefer to use the button panel instead of the card touch screen locations on the video screen display 20.

In the preferred embodiment of the present invention, when the initial five card hand is displayed on the video screen display 20, the player must choose which cards to hold by either pressing the card location on the touch screen or by pressing the HOLD button associated with the card position. Alternatively, it is possible to provide what is known as an "Auto-hold" feature to the method of play. When an "Auto-hold" is in use, the computer controls of the gaming machine analyze the initially displayed hand and suggest a HOLD to those cards that would give the player the best mathematical probability for that initial hand based on the pay table that is being used. The player can accept the suggested "Auto-hold" by pressing the DRAW location or the DRAW button and the draw step will take place. If the player declines the suggested "Auto-hold", the player must unhold any cards that were held by the "Auto-hold" if the player wishes to discard those cards and the player must manually hold any other cards that the player wishes to hold. The use of an "Auto-hold" feature speeds up play by increasing the number of hands per hour that can be played on the gaming machine.

The gaming machine 10 also includes a coin head 50 to allow the player to insert coins or gaming tokens as wagers to allow play of the gaming machine 10. A bill acceptor slot 52 is also provided on the gaming machine 10. In order to accrue credits that may be used to play the gaming machine 10, the player inserts paper currency or other suitable script or gaming coupons into the bill acceptor slot 52 behind which, on the interior of the gaming machine, is mounted a bill acceptor which takes in and validates the currency. The monetary value of the inserted currency is then applied to the credit meter 22, the credits on which the player may use to play the gaming machine.

Any other conventional and suitable equipment can be included in the gaming machine.

In order to play a round of the game of the present invention, a player must make an initial wager, preferably five credits. The deck of playing cards is electronically shuffled and, after the player has made his initial five credit wager, a first hand of five cards is displayed to the player.

If the player has a "pat" hand such as a Straight or Flush, the player will simply stand on this pat hand and receive an award based on a five credit wager as shown in a the pay table for the poker hand ranking achieved by the player.

However, if the player wishes to hold certain cards and discard unwanted cards, then the player will press the "Hold" button or touch screen location associated with the cards the player wishes to hold. The unheld cards will be discarded and replacement cards will be displayed for the discarded cards. The player must make an additional wager, preferably in the amount of one credit, for each card that the player wishes to discard. The resulting five card hand is the player's final hand and the player will receive an award based on the poker hand ranking of the final five card hand as shown in the pay table and based on the total number of credits wagered by the player—both the initial five credit wager and each additional credit wagered during the draw step.

Any suitable pay table may be used based on the poker game format being used and the overall game percentage which the gaming establishment wishes to offer the players for this game. A representative pay table that can be used in the method of play of the present invention is shown in Table 1:

TABLE 1

| | NUMBER OF CREDITS WAGERED | | | | | |
|---|---|---|---|---|---|---|
| POKER HAND | 5 | 6 | 7 | 8 | 9 | 10 |
| ROYAL FLUSH | 4000 | 4800 | 5600 | 6400 | 7200 | 8000 |
| STRAIGHT FLUSH | 250 | 300 | 350 | 400 | 450 | 500 |
| FOUR ACES WITH ANY 2, 3 OR 4 | 3000 | 3600 | 4200 | 4800 | 5400 | 6000 |
| FOUR 2'S, 3'S OR 4'S WITH ANY ACE, 2, 3 OR 4 | 800 | 960 | 1120 | 1280 | 1440 | 1600 |
| FOUR ACES | 800 | 960 | 1120 | 1280 | 1440 | 1600 |
| FOUR 2'S, 3'S OR 4'S | 400 | 480 | 560 | 640 | 720 | 800 |

TABLE 1-continued

| POKER HAND | NUMBER OF CREDITS WAGERED | | | | | |
|---|---|---|---|---|---|---|
| | 5 | 6 | 7 | 8 | 9 | 10 |
| FOUR 5'S THRU KINGS | 250 | 300 | 350 | 400 | 450 | 500 |
| FULL HOUSE | 50 | 60 | 70 | 80 | 90 | 100 |
| FLUSH | 35 | 42 | 49 | 56 | 63 | 70 |
| STRAIGHT | 20 | 24 | 28 | 32 | 36 | 40 |
| THREE-OF-A-KIND | 15 | 18 | 21 | 24 | 27 | 30 |
| TWO PAIR | 5 | 6 | 7 | 8 | 9 | 10 |
| JACKS OR BETTER | 5 | 6 | 7 | 8 | 9 | 10 |

This pay table has been created based on the assumption that the player's initial wager must be in the amount of five credits and that the player must wager one additional credit for each card the player wishes to discard. The pay table shown in Table 1 is a preferred pay table when the method of play of the present invention is applied to a Double Double Bonus Draw Poker game format, but any suitable pay table can be used. This pay table offers the player a mathematical game return of 98.62%. The mathematical game return may be increased or decreased by changing the payouts for the various winning hand combinations.

Examples will now be set out showing how the method of play of the present invention could proceed.

EXAMPLE 1

The player makes a five credit wager and is dealt an initial hand of the following five cards which are shown in FIG. 1: Ace of Hearts 111, Ace of Clubs 112, Four of Diamonds 113, Six of Spades 114 and Ace of Spades 115. The obvious play in this example is for the player to hold the threes Aces and the discard the Four of Diamonds 113 and Six of Spades 114. The player would make an additional wager of two credits in order to discard these two cards. The player would hold the three Aces and press the DRAW button to activate the computer controls to discard the unheld cards and display replacement cards from the original deck of playing cards. The computer controls would also decrement the credit meter by two credits to reflect the additional wager required for the draw step. If the player did not have sufficient credits on the credit meter, the computer controls would prompt the player to insert additional coins, gaming tokens or currency in order for the player to continue.

Figure 2:
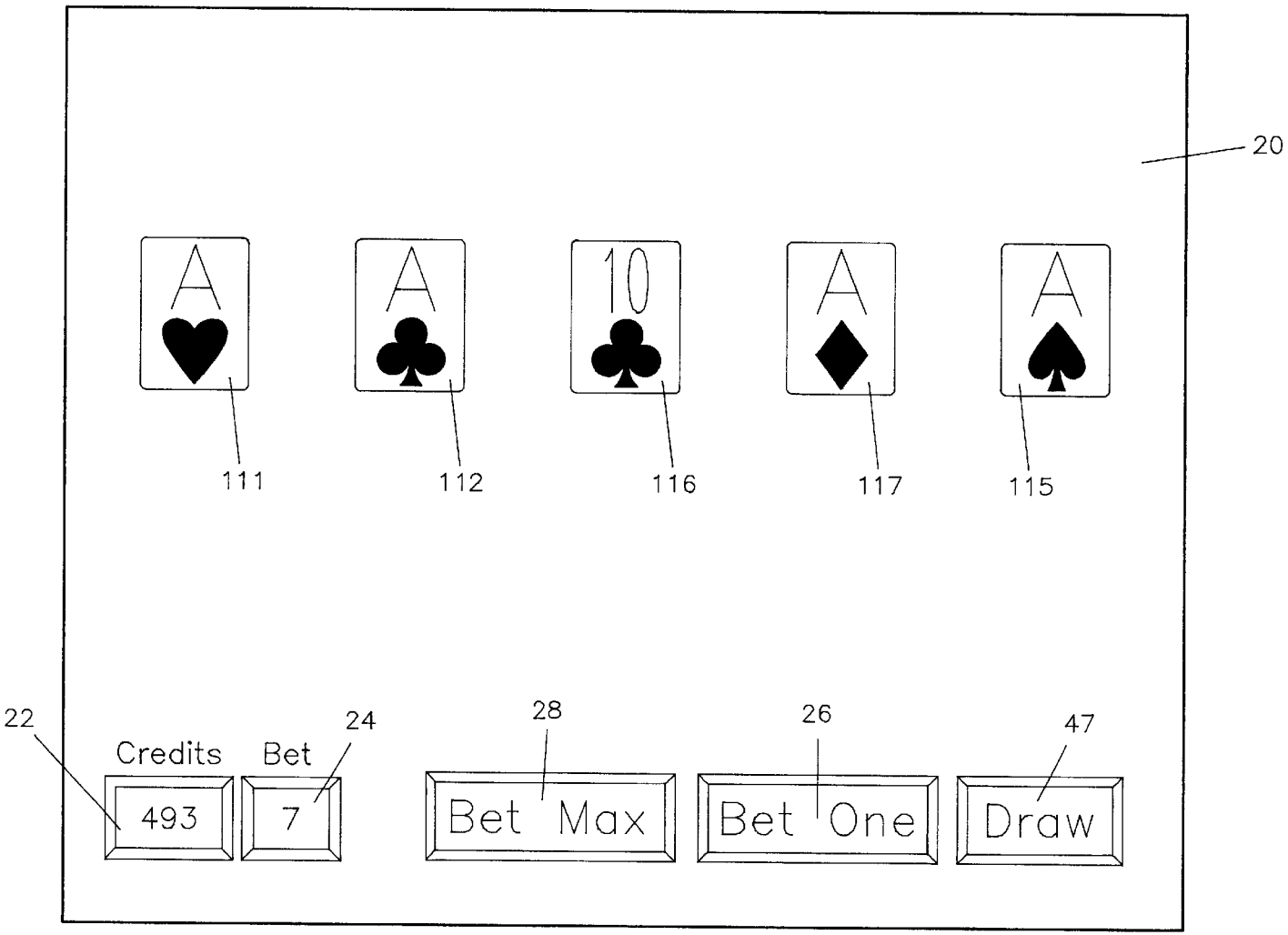
FIG. 2 shows the screen display after the replacement cards have been dealt resulting in the final five card hand for Example 1.

FIG. 2 shows that the player drew the Ten of Clubs 116 and the Ace of Diamonds 117 as the replacement cards. The player achieved a final hand of Four Aces. The player is paid 1120 credits based on a total wager of seven credits and a final hand of Four Aces as shown in the pay table, Table 1.

EXAMPLE 2

Figure 3:
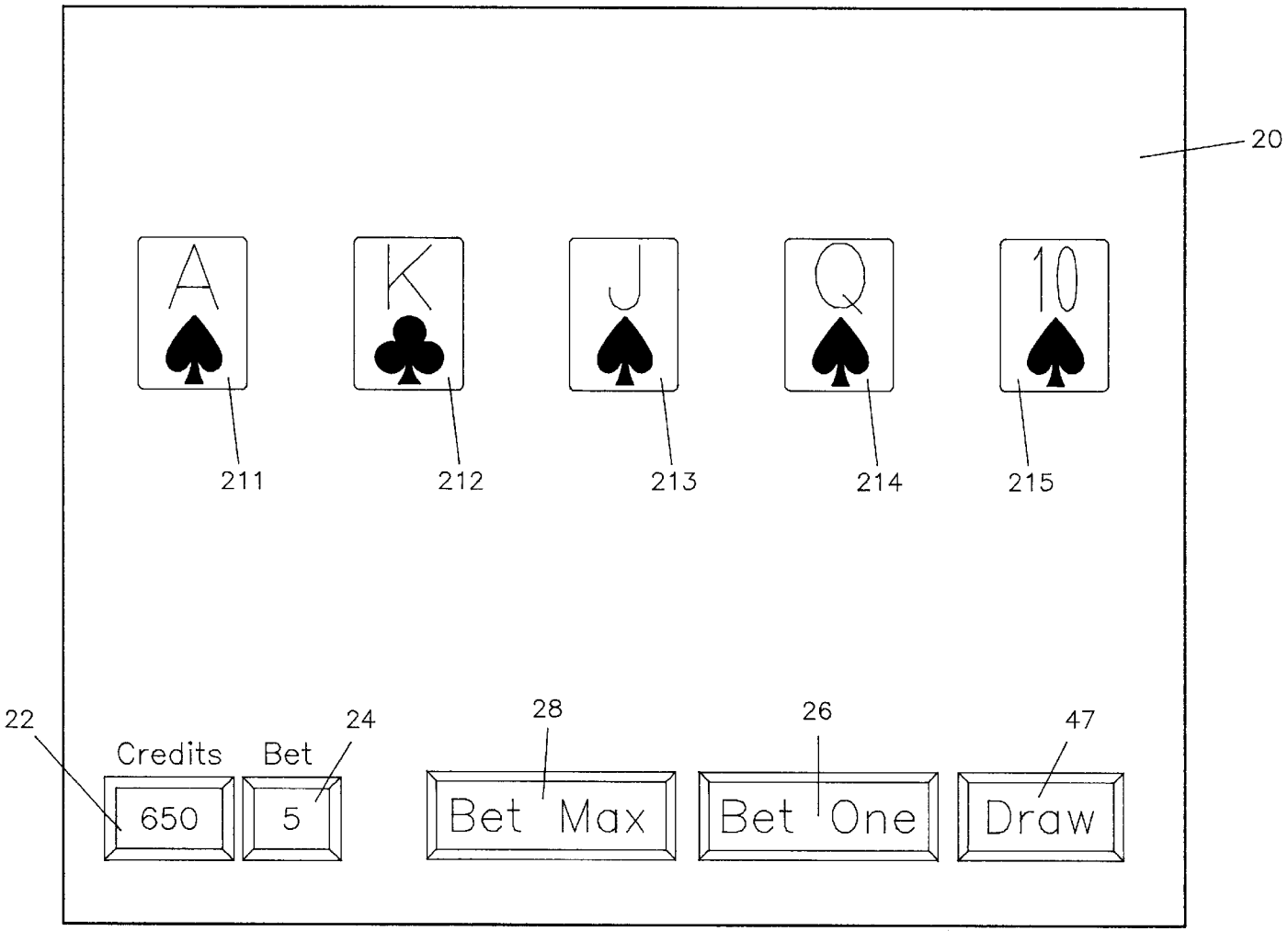
FIG. 3 shows the screen display showing the initial deal of cards for Example 2.

The player makes a five credit wager and is dealt an initial hand of the following five cards which are shown in FIG. 3: Ace of Spades 211, King of Clubs 212, Jack of Spades 213, Queen of Spades 214 and Ten of Spades 215. The player has a "pat" hand of a Straight and the player would simply hold all five cards and collect a payout of 20 credits as shown in Table 1 for a winning hand combination of a Straight and five credits wagered. Alternatively, the player could hold the Ace of Spades 211, Jack of Spades 213, Queen of Spades 214 and Ten of Spades 215; discard the King of Clubs 212; make an additional wager of one credit to draw one card and try to achieve a Royal Flush or other winning hand combination. If the player did achieved a winning combination on the draw of an additional card, the player would receive a payout for that winning combination based on a six credit wager as shown in Table 1. If the player did not achieve a winning combination on the draw of the additional card, the player would lose his six credit wager.

EXAMPLE 3

Figure 4:
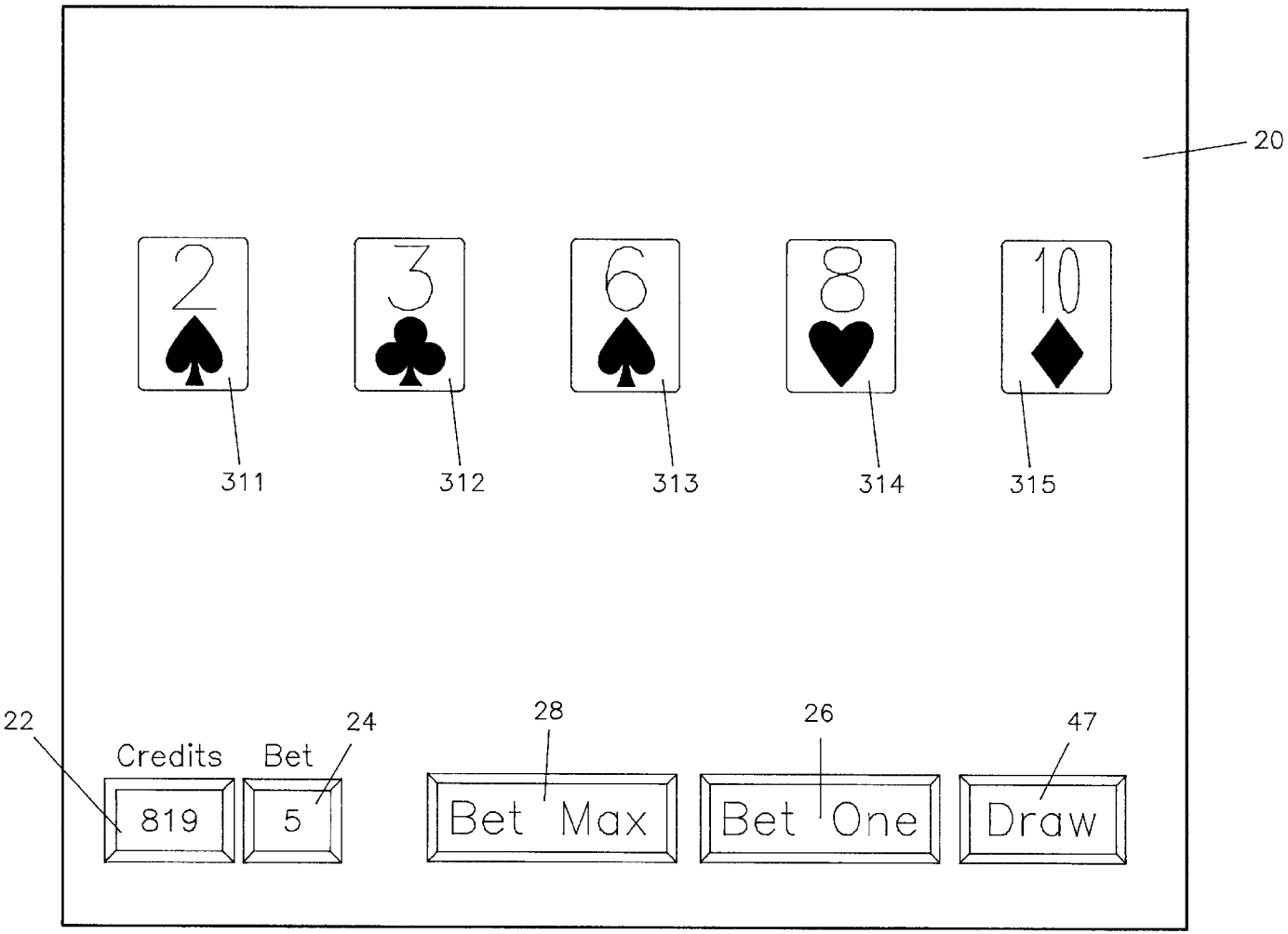
FIG. 4 shows the screen display showing the initial deal of cards for Example 3.

The player makes a five credit wager and is dealt an initial hand of the following five cards which are shown in FIG. 4: Two of Spades 311, Three of Clubs 312, Six of Spades 313, Eight of Hearts 314 and Ten of Diamonds 315. The player has a very poor hand with no realistic chance of improving his hand into a winning combination. In this example, the player would most likely just hold all five cards, accept that this hand is a losing hand and lose his initial wager of five credits. It would not be wise for the player to hold less than all of his initial cards and it would not be wise for the player to discard all five of the initial cards and draw five new cards since it would cost the player five additional credits to throw away all of the initial five cards. That option, however, is available to the player should he so desire which is why the pay table shown in Table 1 shows ten credits as the maximum wager.

EXAMPLE 4

Figure 5:
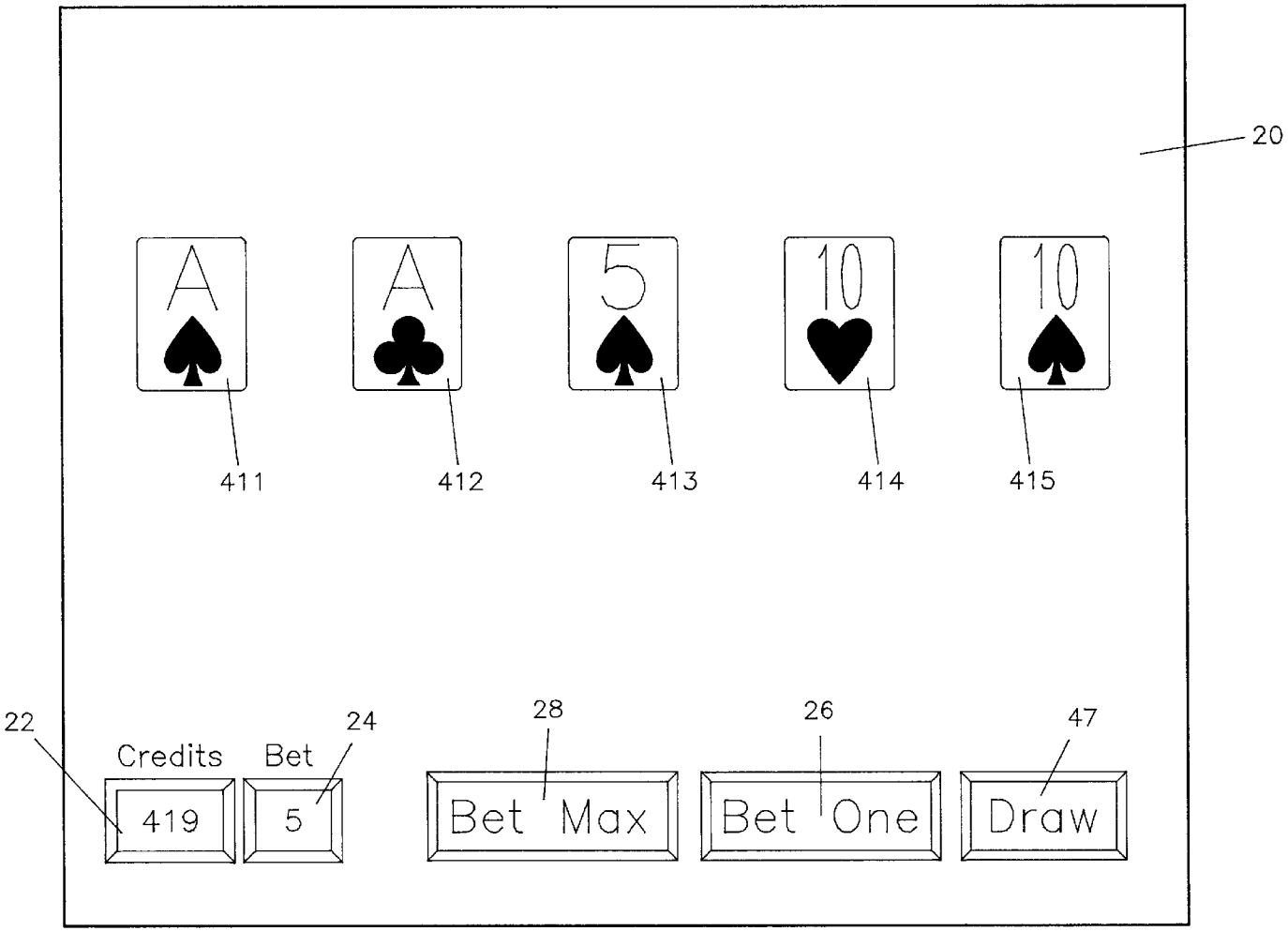
FIG. 5 shows the screen display showing the initial deal of cards for Example 4.

The player makes a five credit wager and is dealt an initial hand of the following five cards which are shown in FIG. 5: Ace of Spades 411, Ace of Clubs 412, Five of Spades 413, Ten of Hearts 414 and Ten of Spades 415. The player has an initial hand of Two Pair. Based on this starting hand, the player has a number of options available to him.

The player could hold the Ace of Spades 411, Ace of Clubs 412, Ten of Hearts 414 and Ten of Spades 415; wager one additional credit; draw one card and try to improve to a Full House. If the player achieves a Full House, the player would be awarded 60 credits based on a six credit wager for a Full House as shown in Table 1. If the player does not achieve a Full House, the player would be still be awarded 6 credits based on a six credit wager for Two Pair as shown in Table 1.

Alternatively, the player could hold just the Ace of Spades 411 and Ace of Clubs 412; wager three additional credits; draw three cards and try to improve to his hand. The best the player could improve to is Four Aces with a Kicker (Four Aces with a Two, Three or Four as the fifth card), in which case the player would be awarded 4800 credits based on an eight credit wager for Four Aces with a Kicker as shown in Table 1. Other payouts would be awarded to the player depending on his final five card hand and based on an eight credit wager. The worst that the player could achieve is a Pair of Aces which would award the player 8 credits based on an eight credit wager for a Pair of Aces as shown in Table 1.

The preferred embodiment of the present invention requires that the player wager five credits at the beginning of each round of play to be eligible to play the game. However, it is also possible to design pay tables which are suitable for use with this method of play that require the player to wager only one, two, three or four credits at the beginning of each round to be eligible to play the game.

Table 2 shows a representative pay table in which the player only wagers one credit at the start of the round of the game. This pay table starts at the initial player wager of one credit and goes up to a maximum wager of six credits should be player discard all five of his initial cards and draw five replacement cards.

TABLE 2

| POKER HAND | NUMBER OF CREDITS WAGERED 1 | 2 | 3 | 4 | 5 | 6 |
|---|---|---|---|---|---|---|
| ROYAL FLUSH | 800 | 1600 | 2400 | 3200 | 4000 | 4800 |
| STRAIGHT FLUSH | 50 | 100 | 150 | 200 | 250 | 300 |
| FOUR ACES WITH ANY 2, 3 OR 4 | 400 | 800 | 1200 | 1600 | 2000 | 2400 |
| FOUR 2'S, 3'S OR 4'S WITH ANY ACE, 2, 3 OR 4 | 160 | 320 | 480 | 640 | 800 | 960 |
| FOUR ACES | 80 | 160 | 240 | 320 | 400 | 480 |
| FOUR 2'S, 3'S OR 4'S | 40 | 80 | 120 | 160 | 200 | 240 |
| FOUR 5'S THRU KINGS | 25 | 50 | 75 | 100 | 125 | 150 |
| FULL HOUSE | 8 | 16 | 24 | 32 | 40 | 48 |
| FLUSH | 5 | 10 | 15 | 20 | 25 | 30 |
| STRAIGHT | 4 | 8 | 12 | 16 | 20 | 24 |
| THREE-OF-A-KIND | 3 | 6 | 9 | 12 | 15 | 18 |
| TWO PAIR | 1 | 2 | 3 | 4 | 5 | 6 |
| JACKS OR BETTER | 1 | 2 | 3 | 4 | 5 | 6 |

This pay table offers the player a mathematical game return of 97.04%. The mathematical game return may be increased or decreased by changing the payouts for the various winning hand combinations.

Table 3 shows a representative pay table in which the player only wagers two credits at the start of the round of the game. This pay table starts at the initial player wager of two credits and goes up to a maximum wager of seven credits should be player discard all five of his initial cards and draw five replacement cards.

TABLE 3

| POKER HAND | NUMBER OF CREDITS WAGERED 2 | 3 | 4 | 5 | 6 | 7 |
|---|---|---|---|---|---|---|
| ROYAL FLUSH | 1600 | 2400 | 3200 | 4000 | 4800 | 5600 |
| STRAIGHT FLUSH | 100 | 150 | 200 | 250 | 300 | 350 |
| FOUR ACES WITH ANY 2, 3 OR 4 | 800 | 1200 | 1600 | 2000 | 2400 | 2800 |
| FOUR 2'S, 3'S OR 4'S WITH ANY ACE, 2, 3 OR 4 | 320 | 480 | 640 | 800 | 960 | 1120 |
| FOUR ACES | 300 | 450 | 600 | 750 | 900 | 1050 |
| FOUR 2'S, 3'S OR 4'S | 150 | 225 | 300 | 375 | 450 | 525 |
| FOUR 5'S THRU KINGS | 90 | 135 | 180 | 225 | 270 | 315 |
| FULL HOUSE | 18 | 27 | 36 | 45 | 54 | 63 |
| FLUSH | 12 | 18 | 24 | 30 | 36 | 42 |
| STRAIGHT | 8 | 12 | 16 | 20 | 24 | 28 |
| THREE-OF-A-KIND | 6 | 9 | 12 | 15 | 18 | 21 |
| TWO PAIR | 2 | 3 | 4 | 5 | 6 | 7 |
| JACKS OR BETTER | 2 | 3 | 4 | 5 | 6 | 7 |

This pay table offers the player a mathematical game return of 97.12%. The mathematical game return may be increased or decreased by changing the payouts for the various winning hand combinations.

Table 4 shows a representative pay table in which the player only wagers three credits at the start of the round of the game. This pay table starts at the initial player wager of three credits and goes up to a maximum wager of eight credits should be player discard all five of his initial cards and draw five replacement cards.

TABLE 4

| POKER HAND | NUMBER OF CREDITS WAGERED 3 | 4 | 5 | 6 | 7 | 8 |
|---|---|---|---|---|---|---|
| ROYAL FLUSH | 2400 | 3200 | 4000 | 4800 | 5600 | 6400 |
| STRAIGHT FLUSH | 150 | 200 | 250 | 300 | 350 | 400 |
| FOUR ACES WITH ANY 2, 3 OR 4 | 1650 | 2200 | 2750 | 3300 | 3850 | 4400 |
| FOUR 2'S, 3'S OR 4'S WITH ANY ACE, 2, 3 OR 4 | 480 | 640 | 800 | 960 | 1120 | 1280 |
| FOUR ACES | 450 | 600 | 750 | 900 | 1050 | 1200 |
| FOUR 2'S, 3'S OR 4'S | 225 | 300 | 375 | 450 | 525 | 600 |
| FOUR 5'S THRU KINGS | 150 | 200 | 250 | 300 | 350 | 400 |
| FULL HOUSE | 30 | 40 | 50 | 60 | 70 | 80 |
| FLUSH | 18 | 24 | 30 | 36 | 42 | 48 |
| STRAIGHT | 12 | 16 | 20 | 24 | 28 | 32 |
| THREE-OF-A-KIND | 9 | 12 | 15 | 18 | 21 | 24 |
| TWO PAIR | 3 | 4 | 5 | 6 | 7 | 8 |
| JACKS OR BETTER | 3 | 4 | 5 | 6 | 7 | 8 |

This pay table offers the player a mathematical game return of 97.38%. The mathematical game return may be increased or decreased by changing the payouts for the various winning hand combinations.

Table 5 shows a representative pay table in which the player only wagers four credits at the start of the round of the game. This pay table starts at the initial player wager of four credits and goes up to a maximum wager of nine credits should be player discard all five of his initial cards and draw five replacement cards.

TABLE 5

| POKER HAND | NUMBER OF CREDITS WAGERED 4 | 5 | 6 | 7 | 8 | 9 |
|---|---|---|---|---|---|---|
| ROYAL FLUSH | 3200 | 4000 | 4800 | 5600 | 6400 | 7200 |
| STRAIGHT FLUSH | 200 | 250 | 300 | 350 | 400 | 450 |
| FOUR ACES WITH ANY 2, 3 OR 4 | 2300 | 2875 | 3450 | 4025 | 4600 | 5175 |
| FOUR 2'S, 3'S OR 4'S WITH ANY ACE, 2, 3 OR 4 | 640 | 800 | 960 | 1120 | 1280 | 1440 |
| FOUR ACES | 640 | 800 | 960 | 1120 | 1280 | 1440 |
| FOUR 2'S, 3'S OR 4'S | 320 | 400 | 480 | 560 | 640 | 720 |
| FOUR 5'S THRU KINGS | 200 | 250 | 300 | 350 | 400 | 450 |
| FULL HOUSE | 40 | 50 | 60 | 70 | 80 | 90 |
| FLUSH | 28 | 35 | 42 | 49 | 56 | 63 |
| STRAIGHT | 16 | 20 | 24 | 28 | 32 | 36 |
| THREE-OF-A-KIND | 12 | 15 | 18 | 21 | 24 | 27 |
| TWO PAIR | 4 | 5 | 6 | 7 | 8 | 9 |
| JACKS OR BETTER | 4 | 5 | 6 | 7 | 8 | 9 |

This pay table offers the player a mathematical game return of 98.45%. The mathematical game return may be increased or decreased by changing the payouts for the various winning hand combinations.

While the examples of the method of play described above and the various pay tables are shown in conjunction with a Double Double Bonus Poker format, the method of play of the present invention can also be applied to any other format variations of draw poker, such as regular Draw Poker, Deuces Wild Poker, Bonus Poker, Double Bonus Poker, Triple Bonus Poker, Joker's Wild Poker and the like. Each of these video poker format variations uses various arrangements of poker hand rankings as winning combinations. The winning hand combinations can be varied when wild cards are used to reflect the various types of hand combinations that can be achieved, such as Five-of-a-Kind and Wild Royal Flushes.

While the invention has been illustrated with respect to several specific embodiments thereof, these embodiments should be considered as illustrative rather than limiting. Various modifications and additions may be made and will be apparent to those skilled in the art. Accordingly, the invention should not be limited by the foregoing description, but rather should be defined only by the following claims.

What is claimed is:

1. A method of playing a draw poker game comprising:

a) a player making an initial wager to be eligible to play the game;

b) displaying five face up cards to the player;

c) the player selecting one or more of the face up cards as cards to be discarded;

d) the player making an additional wager for each card that has been selected to be discarded;

e) replacing each of the face up cards that were selected to be discarded with a face up card;

f) determining the poker hand ranking of the resulting cards; and g) paying the player a pre-established amount based on the amount of the total wager if the resulting cards comprise a predetermined poker hand ranking.

2. The method of claim 1 in which the initial wager is five credits.

3. The method of claim 2 in which the pre-established amount paid to the player for a winning poker hand combination is determined by a pay table.

4. The method of claim 3 in which the pay table comprises:

| | NUMBER OF CREDITS WAGERED | | | | | |
|---|---|---|---|---|---|---|
| POKER HAND | 5 | 6 | 7 | 8 | 9 | 10 |
| ROYAL FLUSH | 4000 | 4800 | 5600 | 6400 | 7200 | 8000 |
| STRAIGHT FLUSH | 250 | 300 | 350 | 400 | 450 | 500 |
| FOUR ACES WITH ANY 2, 3 OR 4 | 3000 | 3600 | 4200 | 4800 | 5400 | 6000 |
| FOUR 2'S, 3'S OR 4'S WITH ANY ACE, 2, 3 OR 4 | 800 | 960 | 1120 | 1280 | 1440 | 1600 |
| FOUR ACES | 800 | 960 | 1120 | 1280 | 1440 | 1600 |
| FOUR 2'S, 3'S OR 4'S | 400 | 480 | 560 | 640 | 720 | 800 |
| FOUR 5'S THRU KINGS | 250 | 300 | 350 | 400 | 450 | 500 |
| FULL HOUSE | 50 | 60 | 70 | 80 | 90 | 100 |
| FLUSH | 35 | 42 | 49 | 56 | 63 | 70 |
| STRAIGHT | 20 | 24 | 28 | 32 | 36 | 40 |
| THREE-OF-A-KIND | 15 | 18 | 21 | 24 | 27 | 30 |
| TWO PAIR | 5 | 6 | 7 | 8 | 9 | 10 |
| JACKS OR BETTER | 5 | 6 | 7 | 8 | 9 | 10 |

5. The method of claim 1 in which the initial wager is four credits.

6. The method of claim 5 in which the pre-established amount paid to the player for a winning poker hand combination is determined by a pay table.

7. The method of claim 6 in which the pay table comprises:

| | NUMBER OF CREDITS WAGERED | | | | | |
|---|---|---|---|---|---|---|
| POKER HAND | 4 | 5 | 6 | 7 | 8 | 9 |
| ROYAL FLUSH | 3200 | 4000 | 4800 | 5600 | 6400 | 7200 |
| STRAIGHT FLUSH | 200 | 250 | 300 | 350 | 400 | 450 |
| FOUR ACES WITH ANY 2, 3 OR 4 | 2300 | 2875 | 3450 | 4025 | 4600 | 5175 |
| FOUR 2'S, 3'S OR 4'S WITH ANY ACE, 2, 3 OR 4 | 640 | 800 | 960 | 1120 | 1280 | 1440 |
| FOUR ACES | 640 | 800 | 960 | 1120 | 1280 | 1440 |
| FOUR 2'S, 3'S OR 4'S | 320 | 400 | 480 | 560 | 640 | 720 |
| FOUR 5'S THRU KINGS | 200 | 250 | 300 | 350 | 400 | 450 |
| FULL HOUSE | 40 | 50 | 60 | 70 | 80 | 90 |
| FLUSH | 28 | 35 | 42 | 49 | 56 | 63 |
| STRAIGHT | 16 | 20 | 24 | 28 | 32 | 36 |
| THREE-OF-A-KIND | 12 | 15 | 18 | 21 | 24 | 27 |
| TWO PAIR | 4 | 5 | 6 | 7 | 8 | 9 |
| JACKS OR BETTER | 4 | 5 | 6 | 7 | 8 | 9 |

8. The method of claim 1 in which the initial wager is three credits.

9. The method of claim 8 in which the pre-established amount paid to the player for a winning poker hand combination is determined by a pay table.

10. The method of claim 9 in which the pay table comprises:

| | NUMBER OF CREDITS WAGERED | | | | | |
|---|---|---|---|---|---|---|
| POKER HAND | 3 | 4 | 5 | 6 | 7 | 8 |
| ROYAL FLUSH | 2400 | 3200 | 4000 | 4800 | 5600 | 6400 |
| STRAIGHT FLUSH | 150 | 200 | 250 | 300 | 350 | 400 |
| FOUR ACES WITH ANY 2, 3 OR 4 | 1650 | 2200 | 2750 | 3300 | 3850 | 4400 |
| FOUR 2'S, 3'S OR 4'S WITH ANY ACE, 2, 3 OR 4 | 480 | 640 | 800 | 960 | 1120 | 1280 |
| FOUR ACES | 450 | 600 | 750 | 900 | 1050 | 1200 |
| FOUR 2'S, 3'S OR 4'S | 225 | 300 | 375 | 450 | 525 | 600 |
| FOUR 5'S THRU KINGS | 150 | 200 | 250 | 300 | 350 | 400 |
| FULL HOUSE | 30 | 40 | 50 | 60 | 70 | 80 |
| FLUSH | 18 | 24 | 30 | 36 | 42 | 48 |
| STRAIGHT | 12 | 16 | 20 | 24 | 28 | 32 |
| THREE-OF-A-KIND | 9 | 12 | 15 | 18 | 21 | 24 |
| TWO PAIR | 3 | 4 | 5 | 6 | 7 | 8 |
| JACKS OR BETTER | 3 | 4 | 5 | 6 | 7 | 8 |

11. The method of claim 1 in which the initial wager is two credits.

12. The method of claim 11 in which the pre-established amount paid to the player for a winning poker hand combination is determined by a pay table.

13. The method of claim 12 in which the pay table comprises:

| | NUMBER OF CREDITS WAGERED | | | | | |
|---|---|---|---|---|---|---|
| POKER HAND | 2 | 3 | 4 | 5 | 6 | 7 |
| ROYAL FLUSH | 1600 | 2400 | 3200 | 4000 | 4800 | 5600 |
| STRAIGHT FLUSH | 100 | 150 | 200 | 250 | 300 | 350 |
| FOUR ACES WITH ANY 2, 3 OR 4 | 800 | 1200 | 1600 | 2000 | 2400 | 2800 |
| FOUR 2'S, 3'S OR 4'S WITH ANY ACE, 2, 3 OR 4 | 320 | 480 | 640 | 800 | 960 | 1120 |
| FOUR ACES | 300 | 450 | 600 | 750 | 900 | 1050 |
| FOUR 2'S, 3'S OR 4'S | 150 | 225 | 300 | 375 | 450 | 525 |
| FOUR 5'S THRU KINGS | 90 | 135 | 180 | 225 | 270 | 315 |
| FULL HOUSE | 18 | 27 | 36 | 45 | 54 | 63 |

-continued

| POKER HAND | NUMBER OF CREDITS WAGERED | | | | | |
|---|---|---|---|---|---|---|
| | 2 | 3 | 4 | 5 | 6 | 7 |
| FLUSH | 12 | 18 | 24 | 30 | 36 | 42 |
| STRAIGHT | 8 | 12 | 16 | 20 | 24 | 28 |
| THREE-OF-A-KIND | 6 | 9 | 12 | 15 | 18 | 21 |
| TWO PAIR | 2 | 3 | 4 | 5 | 6 | 7 |
| JACKS OR BETTER | 2 | 3 | 4 | 5 | 6 | 7 |

14. The method of claim 1 in which the initial wager is one credit.

15. The method of claim 14 in which the pre-established amount paid to the player for a winning poker hand combination is determined by a pay table.

16. The method of claim 15 in which the pay table comprises:

| POKER HAND | NUMBER OF CREDITS WAGERED | | | | | |
|---|---|---|---|---|---|---|
| | 1 | 2 | 3 | 4 | 5 | 6 |
| ROYAL FLUSH | 800 | 1600 | 2400 | 3200 | 4000 | 4800 |
| STRAIGHT FLUSH | 50 | 100 | 150 | 200 | 250 | 300 |
| FOUR ACES WITH ANY 2, 3 OR 4 | 400 | 800 | 1200 | 1600 | 2000 | 2400 |
| FOUR 2'S, 3'S OR 4'S WITH ANY ACE, 2, 3 OR 4 | 160 | 320 | 480 | 640 | 800 | 960 |
| FOUR ACES | 80 | 160 | 240 | 320 | 400 | 480 |
| FOUR 2'S, 3'S OR 4'S | 40 | 80 | 120 | 160 | 200 | 240 |
| FOUR 5'S THRU KINGS | 25 | 50 | 75 | 100 | 125 | 150 |
| FULL HOUSE | 8 | 16 | 24 | 32 | 40 | 48 |
| FLUSH | 5 | 10 | 15 | 20 | 25 | 30 |
| STRAIGHT | 4 | 8 | 12 | 16 | 20 | 24 |
| THREE-OF-A-KIND | 3 | 6 | 9 | 12 | 15 | 18 |
| TWO PAIR | 1 | 2 | 3 | 4 | 5 | 6 |
| JACKS OR BETTER | 1 | 2 | 3 | 4 | 5 | 6 |

* * * * *